US009454129B2

(12) United States Patent
Okumura

(10) Patent No.: US 9,454,129 B2
(45) Date of Patent: Sep. 27, 2016

(54) IMAGE FORMING APPARATUS COMPOSING ONE FACE OF EXTERIOR COVER BY PARTLY OVERLAPPING COVER BOARDS

(71) Applicant: KYOCERA Document Solutions Inc., Osaka (JP)

(72) Inventor: Keiji Okumura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/924,306

(22) Filed: Oct. 27, 2015

(65) Prior Publication Data

US 2016/0124379 A1 May 5, 2016

(30) Foreign Application Priority Data

Oct. 31, 2014 (JP) ..... 2014-222253

(51) Int. Cl.
*G03G 15/00* (2006.01)
*G03G 21/16* (2006.01)

(52) U.S. Cl.
CPC ..... *G03G 21/1633* (2013.01); *G03G 21/1619* (2013.01)

(58) Field of Classification Search
CPC ..... G03G 21/16; G03G 21/1604; G03G 21/1609
USPC ..... 399/107
See application file for complete search history.

(56) References Cited

U.S. PATENT DOCUMENTS

2011/0013930 A1* 1/2011 Nishida ..... G03G 15/00 399/107

FOREIGN PATENT DOCUMENTS

JP 2000-293076 A 10/2000
JP 2006-301071 A 11/2006

* cited by examiner

*Primary Examiner* — Hoang Ngo
(74) *Attorney, Agent, or Firm* — Studebaker & Brackett PC

(57) ABSTRACT

An image forming apparatus includes an exterior cover having a plurality of faces. The exterior cover is configured so that one face of the plurality of faces is divided into a plurality of cover boards. The plurality of cover boards are configured so that adjacent cover boards of the plurality of cover boards include respective overlapping parts overlapping onto each other formed in the respective adjacent cover boards and the one face is composed by overlapping the overlapping parts from the outside in predetermined order.

4 Claims, 14 Drawing Sheets

IMAGE FORMING APPARATUS COMPOSING ONE FACE OF EXTERIOR COVER BY PARTLY OVERLAPPING COVER BOARDS

INCORPORATION BY REFERENCE

This application is based on and claims the benefit of priority from Japanese Patent application No. 2014-222253 filed on Oct. 31, 2014, the entire contents of which are incorporated herein by reference.

BACKGROUND

The present disclosure relates to an image forming apparatus including an exterior cover covering an outside of a case housing an image forming part.

An image forming apparatus, such as a copying machine or a printer, includes an exterior cover covering an outside of each face of a case housing an image forming part. The exterior cover is fastened and attached to the case by screws.

A main circuit board controlling an image forming operation of the image forming part, a power supply board and others are often arranged at a rear face of the case. In setting-up, maintenance, extending of an option board or other, it is necessary to detach the exterior cover covering the rear face of the case and to expose the main circuit board and the power supply board. At this time, if the exterior cover is attached to the case by fastening with the screws at a plurality of positions, attaching/detaching of the exterior cover may take time.

On the other hand, an image forming apparatus is proposed, which is configured so as to provide a shield case housing the main circuit board at the rear face of the case and to provide a lid body for the shield case in the exterior cover, and then, to make the shield case conduct to the lid body by attaching the exterior cover to the case.

However, the image forming apparatus as mentioned above, although the exterior cover is fastened to the case with the screws to conduct the shield case and the lid body, because the shield case and the lid body are not directly connected, it is feared that the shield case and the lid body are uncertainly conducted and shielding performance of the main circuit board cannot be achieved. In order to certainly conduct the shield case and the lid body, it is necessary increase the positions of fastening the exterior cover and the case with the screws, and accordingly, there are problems that attaching/detaching of the exterior cover takes further time and the number of screws is increased to increase costs.

SUMMARY

In accordance with an embodiment of the present disclosure, an image forming apparatus includes an exterior cover having a plurality of faces. The exterior cover is configured so that one face of the plurality of faces is divided into a plurality of cover boards. The plurality of cover boards are configured so that adjacent cover boards of the plurality of cover boards include respective overlapping parts overlapping onto each other formed in the respective adjacent cover boards and the one face is composed by overlapping the overlapping parts from the outside in predetermined order.

The above and other objects, features, and advantages of the present disclosure will become more apparent from the following description when taken in conjunction with the accompanying drawings in which a preferred embodiment of the present disclosure is shown by way of illustrative example.

BRIEF DESCRIPTION OF THE DRAWINGS

FIG. 10A is the side sectional view showing the first cover board and the second cover board in an overlapping situation and FIG. 10B is the side sectional view showing the second cover board and the case in an engaging situation.

FIG. 12A is the front view showing the third cover board, in a situation where the lid body is fitted to the case, and FIG. 12B is the front view showing the third cover board, in a situation where the lid body is slid with respect to the case.

FIG. 14A is the side sectional view showing the second cover board and the third cover board in an overlapping situation and FIG. 14B is the side sectional view showing the third cover board and the case in an engaging situation.

DETAILED DESCRIPTION

In the following, with reference to the accompanying drawings, an image forming apparatus according to an embodiment of the present disclosure will be described.

Figure 1:
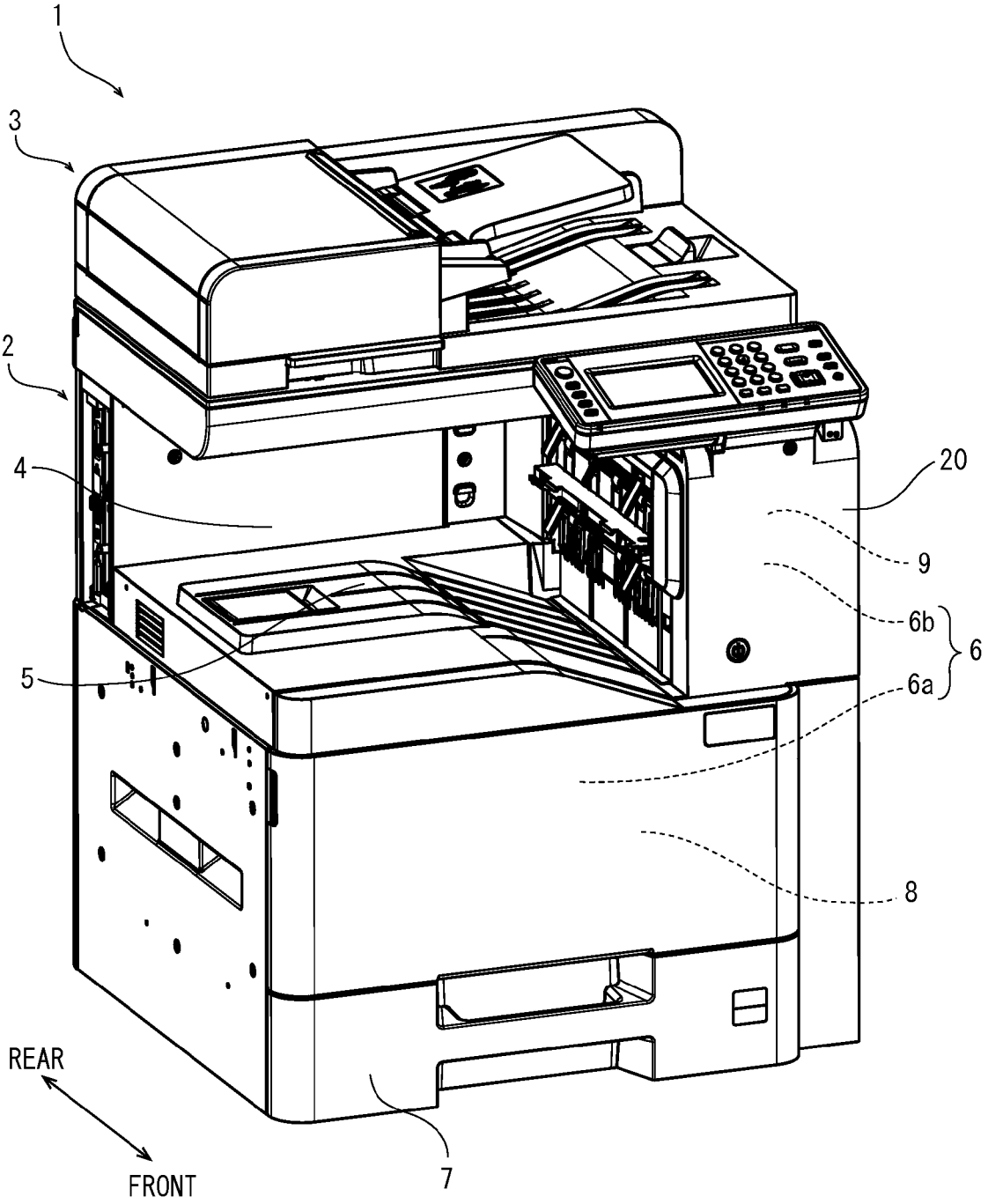
FIG. 1 is a perspective view showing the whole of a color printer, as viewed from a front side, according to an embodiment of the present disclosure.

With reference to FIG. 1, the entire structure of a color printer 1 as the image forming apparatus will be described. FIG. 1 is a perspective view of the color printer as viewed from a front side. Hereinafter, it will be described so that the front side of the color printer 1 is positioned at the near side on FIG. 1. The description of FIG. 1 is based on left and right directions when the color printer 1 is viewed from the front side.

As shown in FIG. 1, the color printer 1 includes an image forming unit 2 and an image reading unit 3 arranged above the image forming unit 2. In the image forming unit 2, below the image reading unit 3, an in-body sheet ejection space 4 opening at a front face and a left side face is arranged and, below the in-body sheet ejection space 4, an ejected sheet tray 5 is arranged. The image forming unit 2 includes a roughly rectangular parallelepiped case 6 and, in the case 6, a lower hollow part 6*a* below the ejected sheet tray 5 and an upper hollow part 6*b* at a right side of the in-body sheet ejection space 4 are provided. In the lower hollow part 6*a*, a sheet feeding cartridge 7 is installed at a lower side and an image forming part 8 forming an image by using four toners is housed above the sheet feeding cartridge 7. In the upper hollow part 6*b*, a sheet ejecting part 9 ejecting the sheet having the formed image is housed. The sheet fed from the sheet feeding cartridge 7 is ejected to the ejected sheet tray 5 through the sheet ejecting part 9 after the image is formed by the image forming part 8. Moreover, the case 6 has an exterior cover 20 covering outside faces of the respective hollow parts.

Figure 2:
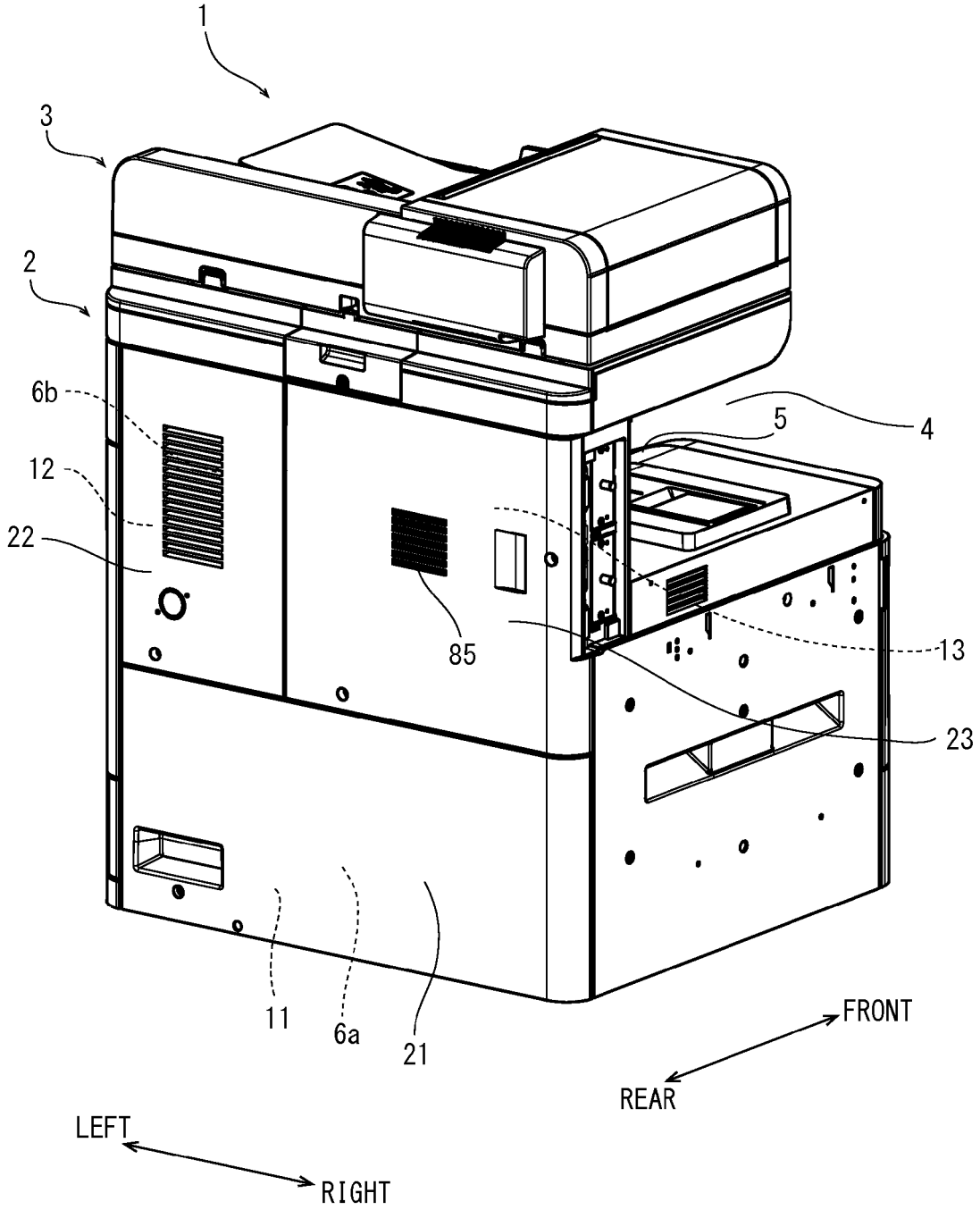
FIG. 2 is a perspective view showing the whole of the color printer, as viewed from a back side, according to the embodiment of the present disclosure.

With reference to FIG. 2, a rear face of the image forming unit 2 will be described. FIG. 2 is a perspective view of a rear part of the color printer 1. Hereinafter, the color printer 1 will be described as viewed from a back side. The description of FIGS. 2-14B is based on left and right directions when the color printer 1 is viewed from the back side.

In the image forming unit 2, a rear face of the case 6 is opened in a rectangular shape and divided into a first section 11 at the back side of the lower hollow part 6*a*, a second section 12 at the back side of the upper hollow part 6*b* and a third section 13 at the back side of the in-body sheet ejection space 4. The exterior cover 20 covering the rear face of the case 6 is composed of a first cover board 21, a second cover board 22 and a third cover board 23 respectively covering the first section 11, the second section 12 and the third section 13.

Figure 3:
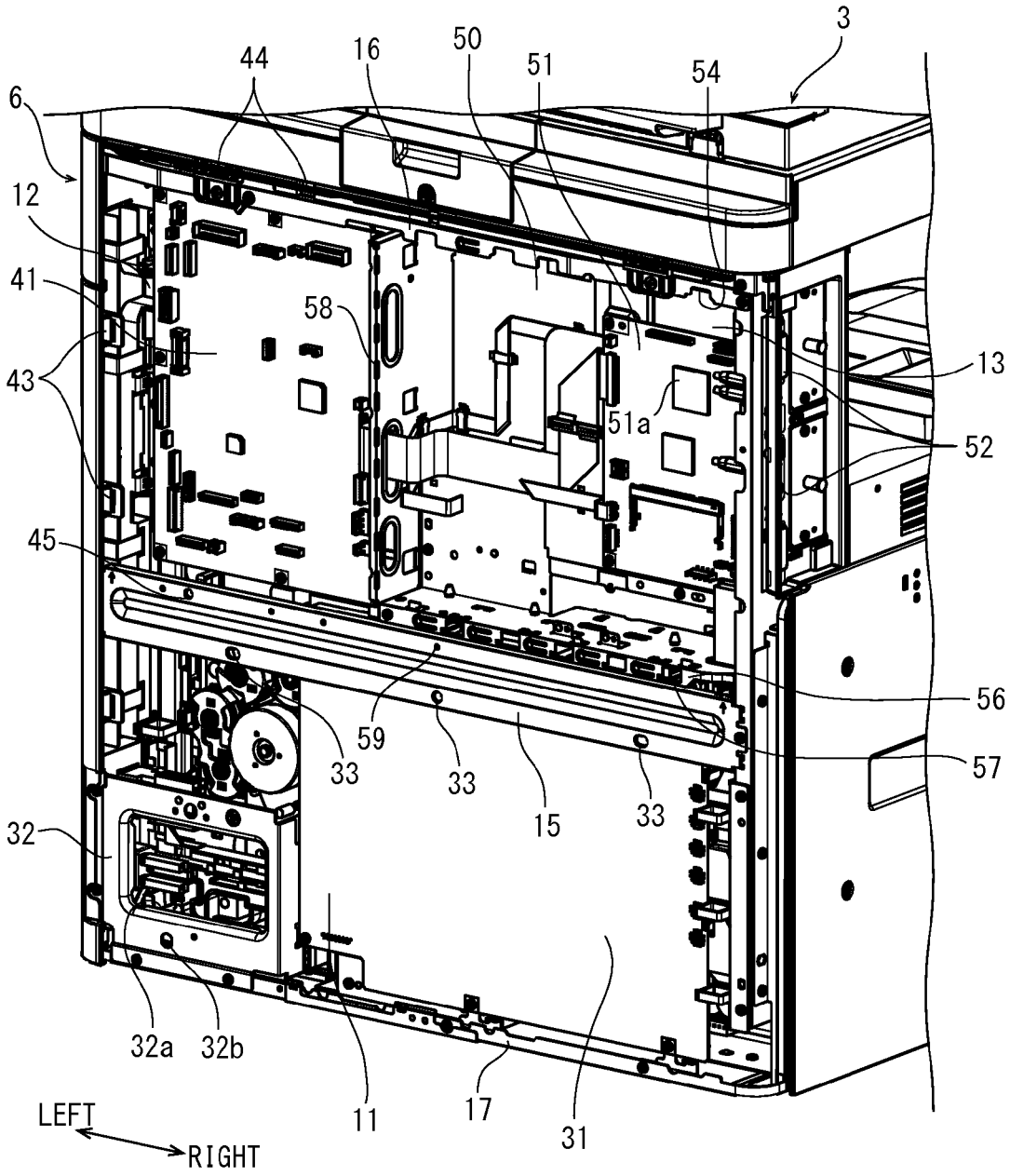
FIG. 3 is a perspective view showing a rear face of a case in the color printer according to the embodiment of the present disclosure.

With reference to FIG. 3, the rear face of the case 6 will be described. FIG. 3 is a perspective view of the rear face of the case 6.

In the rear face of the case 6, an electro-conductive center frame 15 is bridged in the left and right directions between the first section 11 and the second section 12 or the third section 13 (i.e. above the first section 11 and below the second section 12 and the third section 13) and an electro-conductive upper frame 16 is bridged in the left and right directions along an upper edge of the rear face. In a lower edge of the rear face, a lower edge part 17 bent upwardly is formed.

In the first section 11, approximately two three at its right side is closed by an interior cover board 31 and, in its left bottom corner, a grip frame 32 reinforcing a grip is arranged. In the grip frame 32, an opening 32*a* is formed and, below the opening 32*a*, a screw hole 32*b* is formed. Moreover, in the center frame 15 at an upper edge of the first section 11, through holes 33 are formed at predetermined intervals.

In the second section 12, an engine circuit board controlling operations of components of the image forming unit 2 is arranged. At a left edge of the second section 12, left engaged parts 43 having respective through holes bored in forward and backward directions are formed at two position at an interval in upward and downward directions. Further, in an upper edge of the second section 12, an upper engaged part 44 formed at a rear bottom corner of the image reading unit 3 is vertically suspended. The upper engaged part 44 is formed in an L-shape as viewed from a left side to have a suspending part suspending downwardly and a horizontal part bent backwardly from a lower end of the suspending part. In the suspending part, a hole bored in the forward and backward directions is formed. Moreover, in the center frame 15 at a left bottom corner of the second section 12, a screw hole 45 is formed.

In the third section 13, a shield case 50 is arranged and fastened to the upper frame 16 and the center frame 15 by screws and electrically connected to the upper frame 16 and the center frame 15. The shield case 50 is a box-like member, in which a back side face is opened, to include a bottom plate, upper and lower side plates facing to each other in the upward and downward directions and left and right side plates facing to each other in the left and right directions. In the shield case 50, a main circuit board 51 is housed on the bottom plate. The main circuit board 51 is a circuit board controlling the engine circuit board 41 so as to carrying out an image forming operation on the basis of an image read by the image reading unit 3, on which CPU 51*a* and various electronic components are mounted. In order to break electromagnetic waves generated from CPU or the like and to prevent malfunction of the CPU due to high frequency noise or the like, the main circuit board 51 is housed in the shield case 50. On a right side face of the shield case 50, slots 52 used for extending circuit boards are formed in parallel in the upward and downward directions.

Inside the shield case 50, in the upper frame 16, a plurality notches 54 cut out in its inside edge are arranged in parallel in the left and right directions. Moreover, along a lower edge of the shield case 50, an electro-conductive lower frame 56 is conductively fixed and, in the lower frame 56, a plurality of openings 57 are formed in parallel in the left and right directions. Each opening 57 is formed in a lateral rectangular shape, in which an extension part 57*a* extending from a lower part of its left edge in the left direction is formed. In addition, along the left edge of the shield case 50, a plurality of longitudinal openings 58 are formed in parallel in the upward and downward directions.

Further, in the center frame 15 at a left bottom corner of the third section 13, a screw hole 59 is formed.

Figure 4:
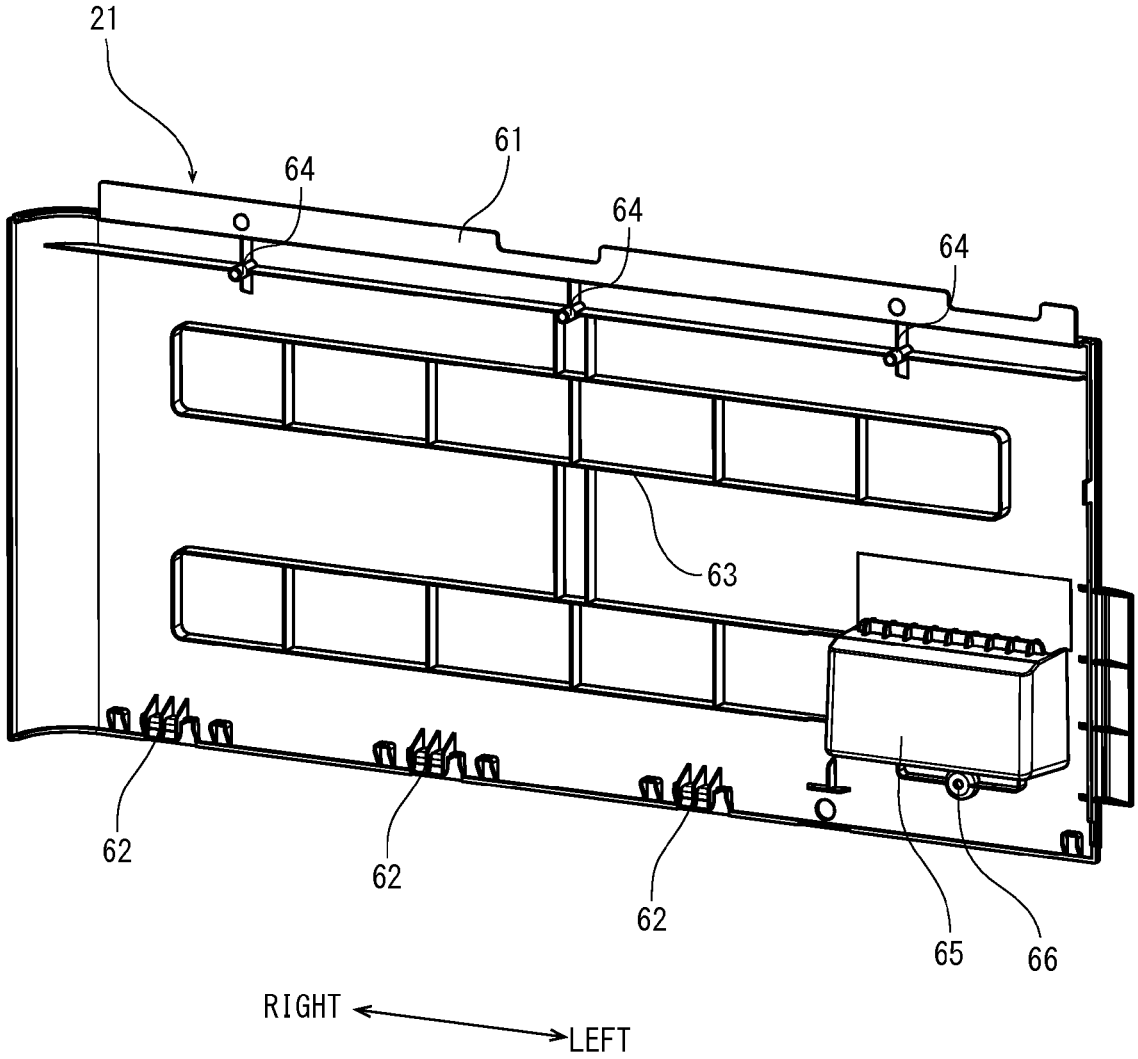
FIG. 4 is a perspective view showing a first cover board, as viewed from the front side, in the color printer according to an embodiment of the present disclosure.
Figure 5:
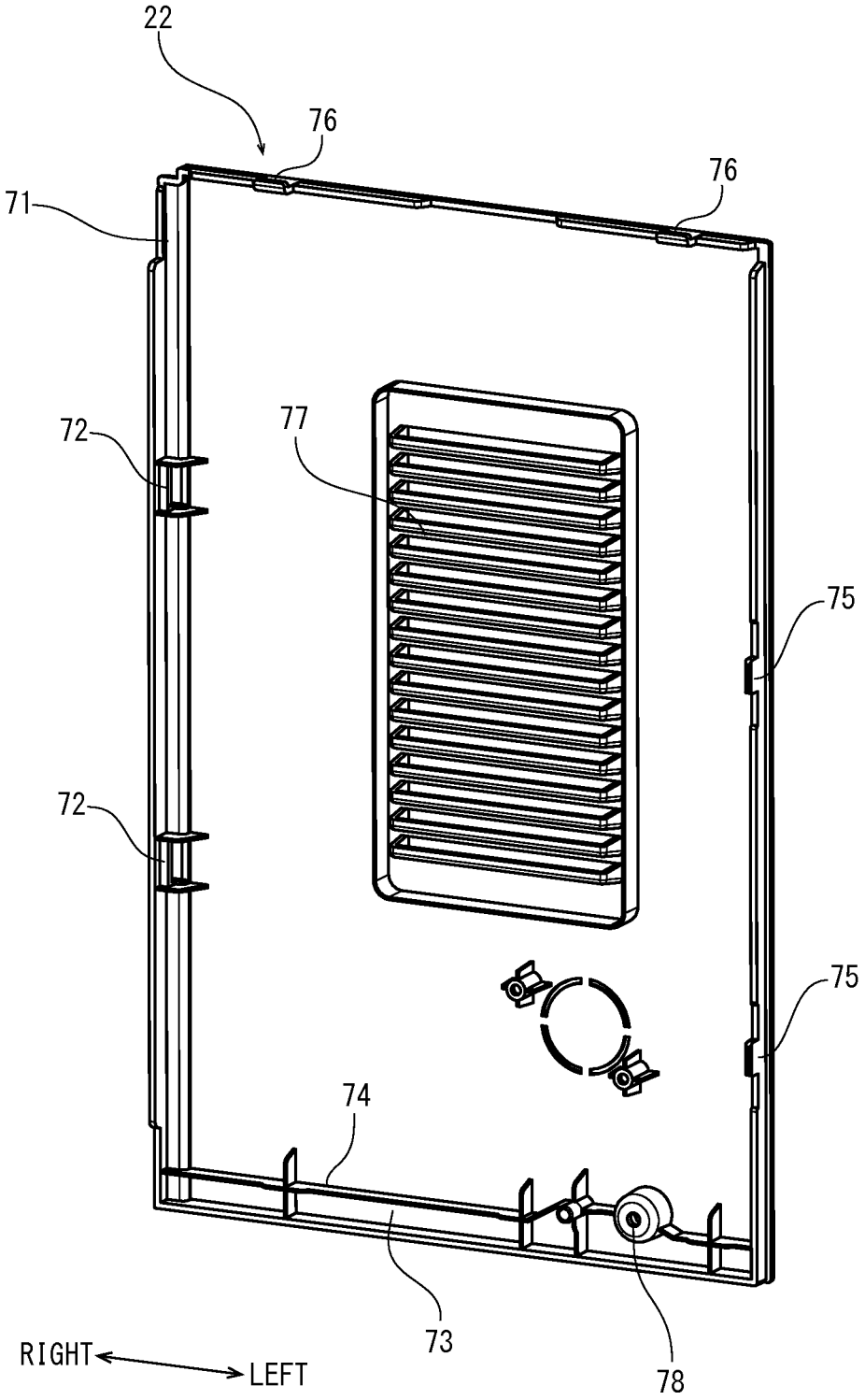
FIG. 5 is a perspective view showing a second cover board, as viewed from the front side, in the color printer according to an embodiment of the present disclosure.
Figure 6:
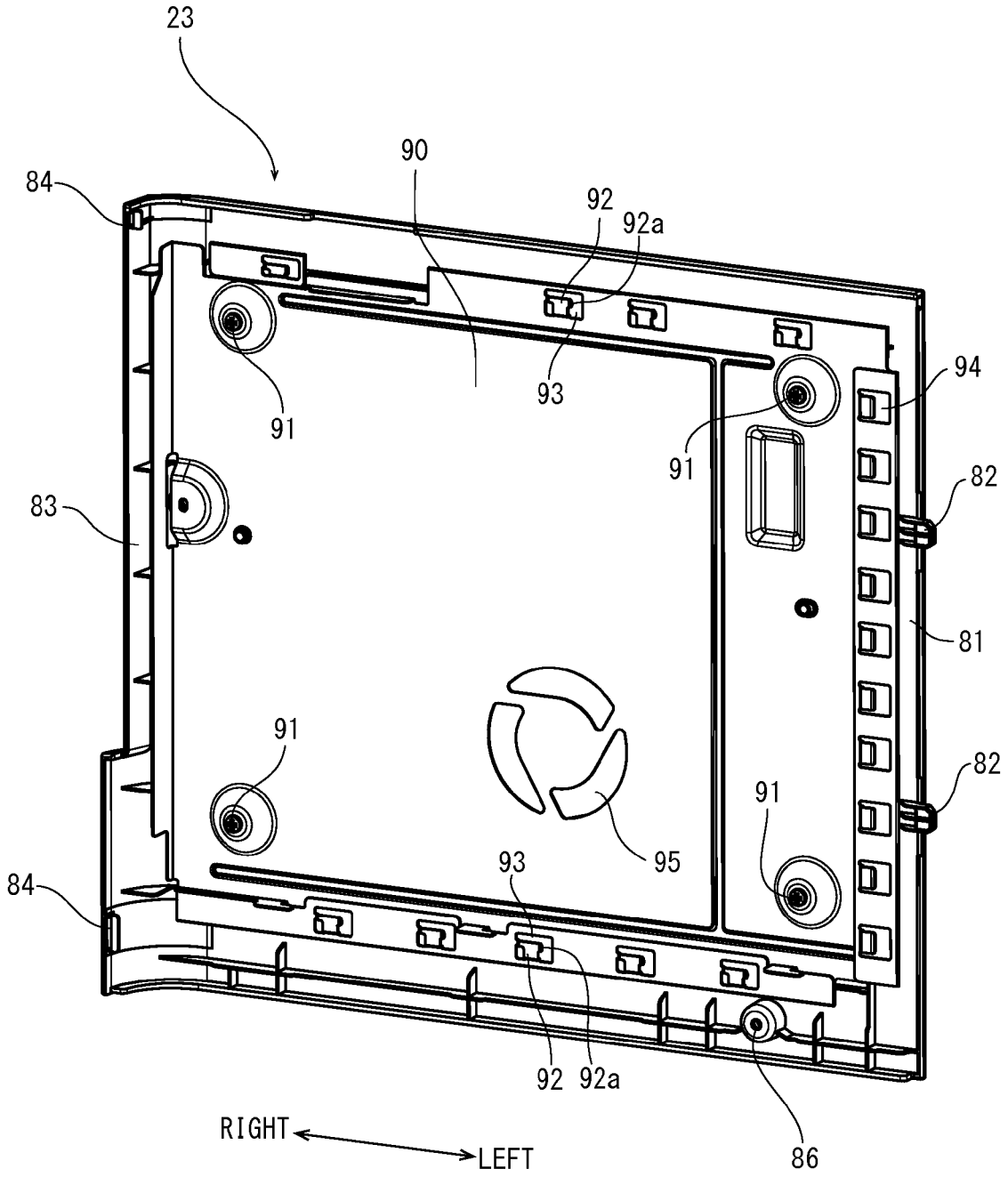
FIG. 6 is a perspective view showing a third cover board, as viewed from the front side, in the color printer according to an embodiment of the present disclosure.

Next, with reference to FIGS. 4-6, each cover board 21, 22 and 23 will be described. FIG. 4 is a perspective view showing a first cover board as viewed from the front side, FIG. 5 is a perspective view showing a second cover board as viewed from the front side and FIG. 6 is a perspective view showing a third cover board as viewed from the front side. Because FIGS. 4-6 are perspective views of each cover board as viewed from the front side, the left and right directions on each drawing are reverse to the left and right directions of the color printer 1 as viewed from the back side.

As shown in FIG. 4, in the first cover board 21 covering the first section 11 of the case 6, an overlapping part 61 extending upwardly along a front edge of a bending part bent forwardly from its upper edge is formed. In its lower edge, claw parts 62 bent in a forward-downward direction are formed at predetermined intervals. In a front face of the first cover board 21, a frame-like rib 63 is formed at its center part and bosses 64 are erected at a slightly lower side from the upper edge at predetermined intervals in the left and right directions. In a rear face of the first cover board 21, a grip part 65 recessed from the front side is formed at a left bottom corner. Below the grip part 65, a screw hole 66 is formed.

As shown in FIG. 5, in the second cover board 22 covering the second section 12 of the case 6, an overlapping part 71 extending in the right direction along a front edge of a bending part bent forwardly from its right edge is formed. In a front face of the second cover board 22, inside the overlapping part 71, two engaged pieces 72 are arranged in parallel in the upward and downward directions. In addition, along a lower end part (an overlapping part) of the front face of the second cover board 22, a rib 74 extending in a horizontal direction and a vertical direction is formed. Moreover, in a left edge of the second cover board 22, two protruding pieces 75 extending forwardly are formed in parallel in the upward and downward directions and, in an upper edge of the second cover board 22, two claw pieces 76 extending forwardly are formed in parallel in the left and right directions. Further, at a roughly center part of the second cover board 22, an air vent 77 is formed and, at a left bottom corner of the second cover board 22, a screw hole 78 is formed.

As shown in FIG. 6, in the third cover board 23 covering the third section 13 of the case 6, on a front face of a left edge part 81 (an overlapping part), two engaging pieces 82 protruding in the left direction are arranged in parallel in the upward and downward directions. Further, a right edge part 83 is curved forwardly and, in upper and lower end parts of a front face of the right edge part 83, claw pieces 84 protruding in the left direction are formed. Near the center of the third cover board 23, an air vent 85 is formed (refer to FIG. 2). Moreover, at a left bottom corner of the third cover board 23, a screw hole 86 is formed.

Onto a front face of the third cover board 23, an electro-conductive lid body 90 is fastened at four corners by screws 91. The lid body 90 has dimensions covering the opening of the shield case 50. In the lid body 90, along an upper end part and a lower end part, a plurality of claw pieces 92 are respectively formed. Each claw piece is formed so as to be cut and raised inwardly (forwardly) from a bottom side and a right side of a lateral rectangular punched opening 93. In each claw piece 92, a protruding part 92*a* bent forward-diagonally from an upper part of a left side is formed. Further, in a left end part of the lid body 90, a plurality of claw pieces 94 are formed. At a left bottom corner of the lid body 90, an air vent 95 is formed.

A manner of attaching respectively the first cover board 21, the second cover board 22 and the third cover board 23 to the first section 11, the second section 12 and third section 13 of the case with the above-mentioned configuration will be described with reference to FIGS. 7-13B.

Figure 7:
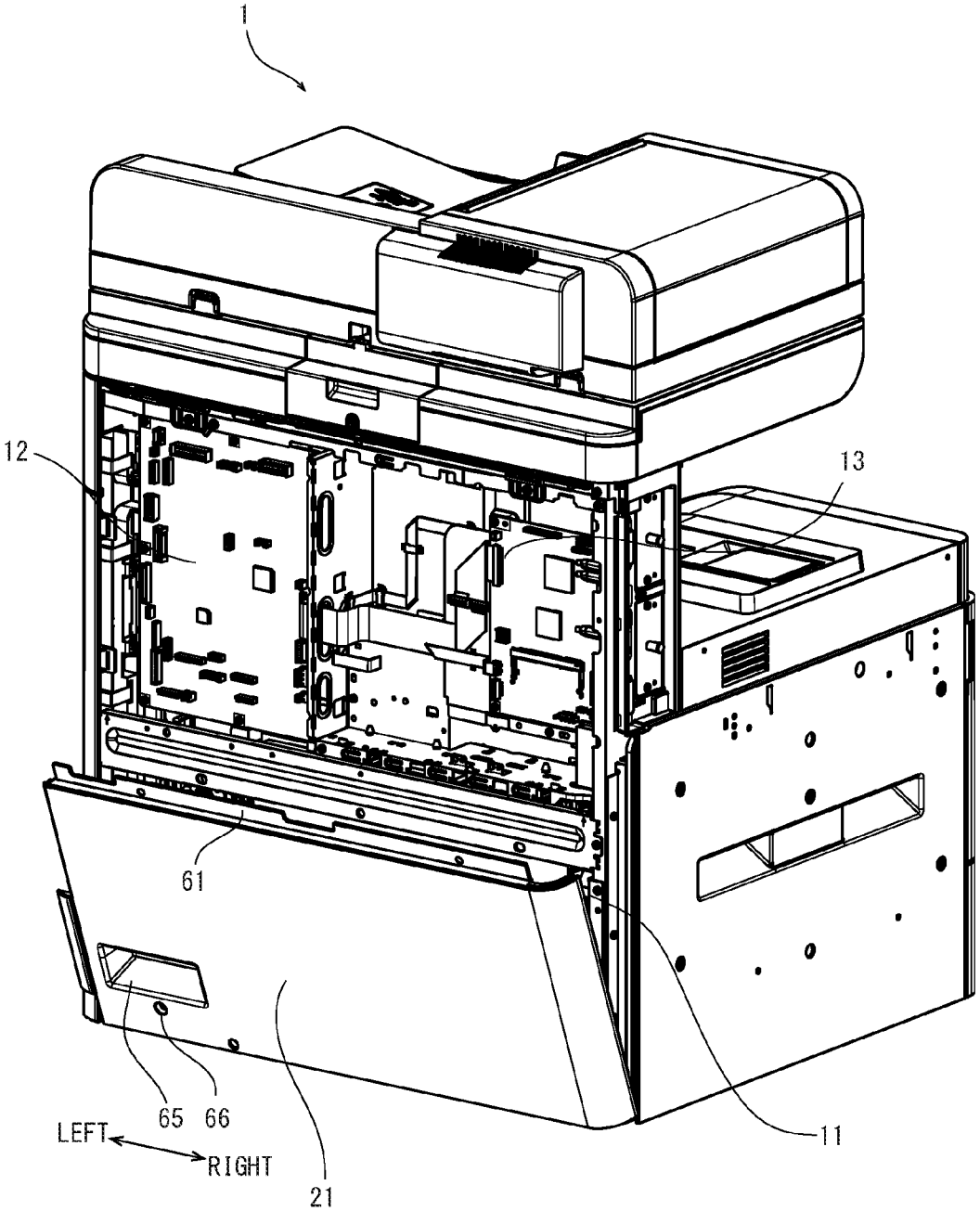
FIG. 7 is a perspective view showing the color printer, when the first cover board is attached, according to the embodiment of the present disclosure.
Figure 8:
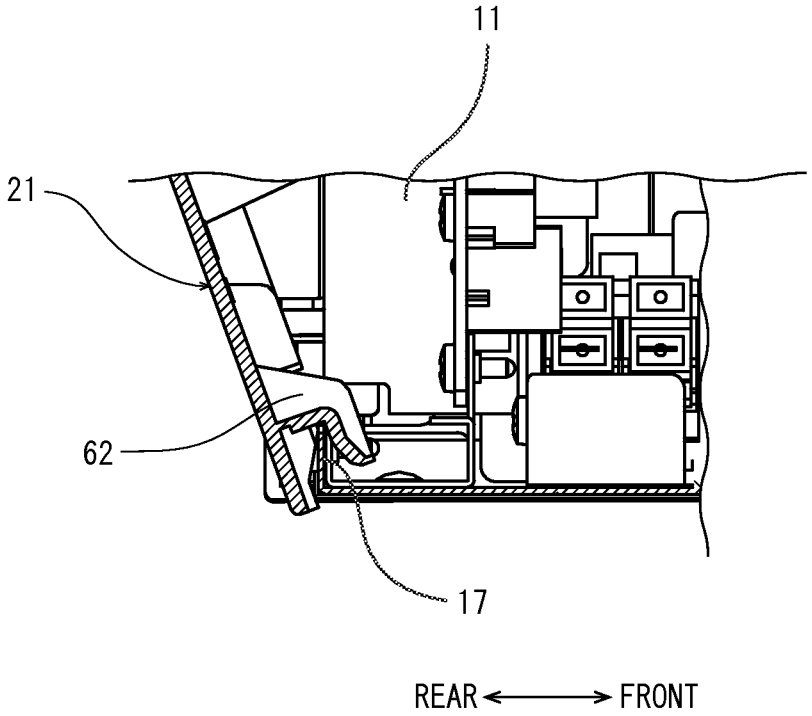
FIG. 8 is a side sectional view showing the first cover board and the case in an engaging situation in the color printer according to the embodiment of the present disclosure.

Firstly, as shown in FIG. 7, the first cover board 21 is attached to the outside of the first section 11. At this time, in the beginning, as shown in FIG. 8, when the claw parts 62 formed in the lower edge of the first cover board 21 are engaged with the lower edge part 17 of the first section 11 and the first cover board 21 is turned forwardly around the claw parts 62, the grip part 65 of the first cover board 21 is fitted into the opening 32*a* of the grip frame 32 of the first section 11, each boss 64 formed in the front face is inserted into each through hole 33 of the center frame 15 and the first section 11 is covered by the first cover board 21. Subsequently, the screw hole 66 formed below the grip part 65 of the first cover board 21 and the screw hole 32*b* of the grip frame 32 of the first section 11 are fastened by a screw. Thereby, the first cover board 21 is attached to the first section 11.

Figure 9:
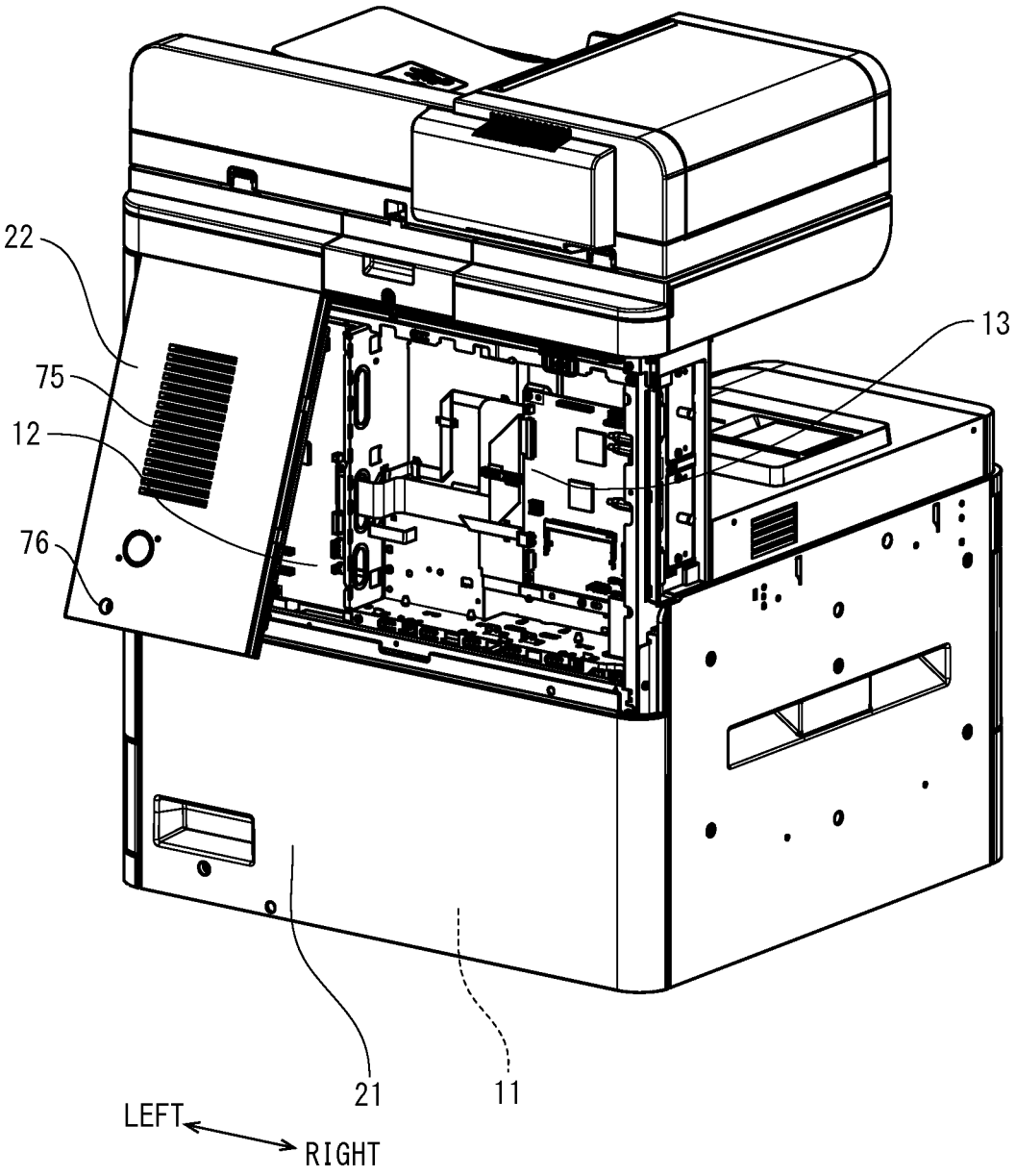
FIG. 9 is a perspective view showing the color printer, when the second cover board is attached, according to the embodiment of the present disclosure.
Figure 10A:
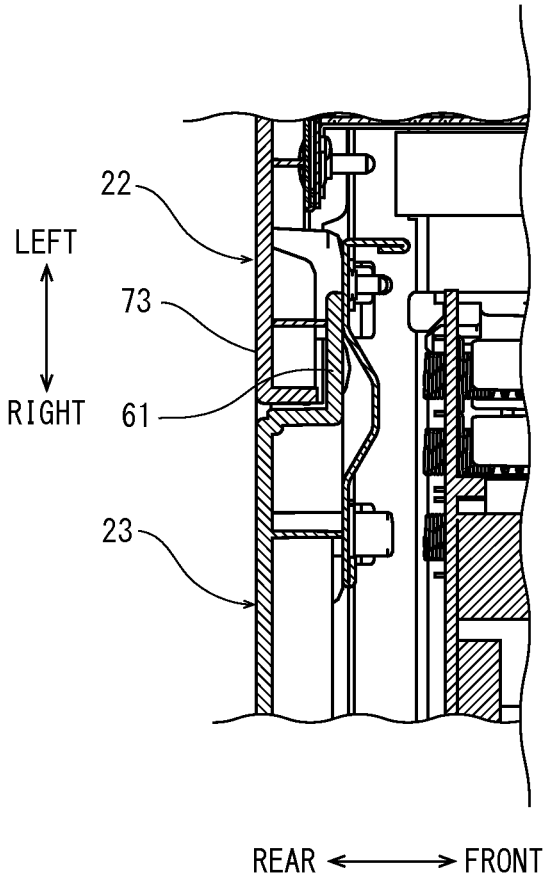
FIGS. 10A and 10B are sectional views showing the second cover in an attaching situation and its peripheral components in the color printer according to the embodiment of the present disclosure.
Figure 10B:
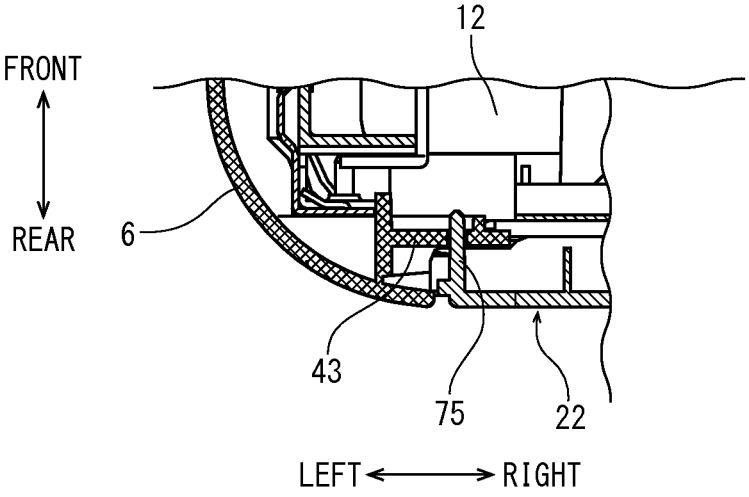

Next, as shown in FIG. 9, the second cover board 22 is attached to the outside of the second section 12. At this time, in the beginning, each claw piece 76 formed in the upper edge of the second cover board 22 is passed through and engaged with the through hole of each upper engaged part 44 vertically suspended from the image reading unit 3. Subsequently, when the second cover board 22 is turned forwardly around the claw pieces 76, as shown in FIG. 10A, the lower end part 73 of the second cover board 22 is overlapped onto the outside of the overlapping part 61 formed in the upper edge of the first cover board 21. Further, the protruding pieces 75 formed in the left edge of the second cover board 22 is inserted, as shown in FIG. 10B, into the through holes of the left engaged parts formed in the left edge of the second section 12. Moreover, the screw hole 78 formed at the left bottom corner of the second cover board 22 and the screw hole 45 formed in the center frame 15 in the second section 12 are fastened by a screw. Thereby, the second cover board 22 is attached to the second section 12.

Figure 11:
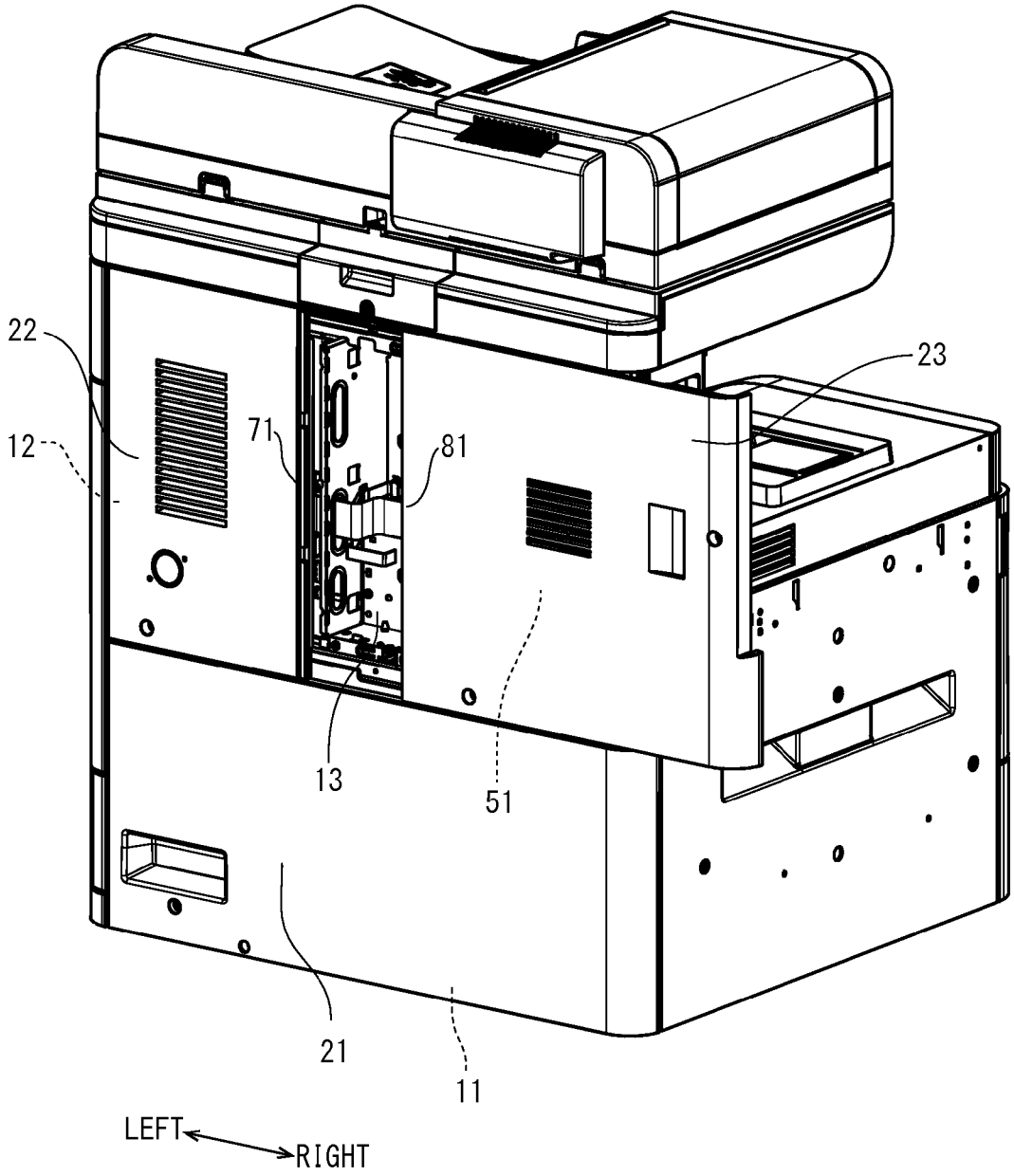
FIG. 11 is a perspective view showing the color printer, when the third cover board is attached, according to the embodiment of the present disclosure.
Figure 12A:
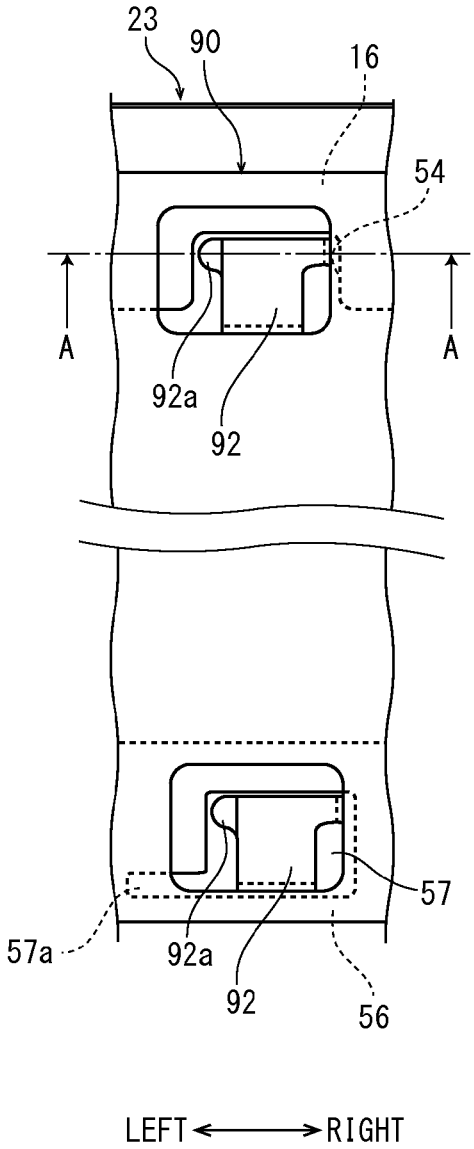
FIGS. 12A and 12B are front views showing the third cover board in sliding work and its peripheral components in the color printer according to the embodiment of the present disclosure.
Figure 13A:
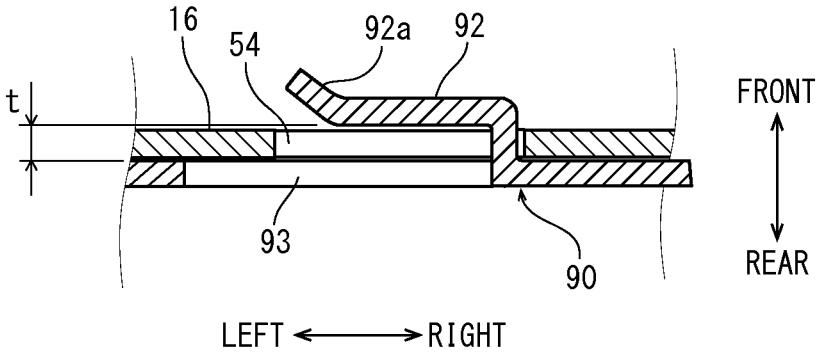
FIG. 13A is a sectional view taken along a line A-A of FIG. 12A

Next, as shown in FIG. 11, the third cover board 23 is attached to the outside of the third section 13. At this time, as shown in FIGS. 12A and 13A, the claw pieces 92 of the lid body 90 attached to the front face of the third cover board 23 are respectively positioned to the notches 54 formed in the upper frame 16 and the openings 57 formed in the lower frame 56 so that each claw piece 92 is fitted into each notch 54 or each opening 57.

Figure 12B:
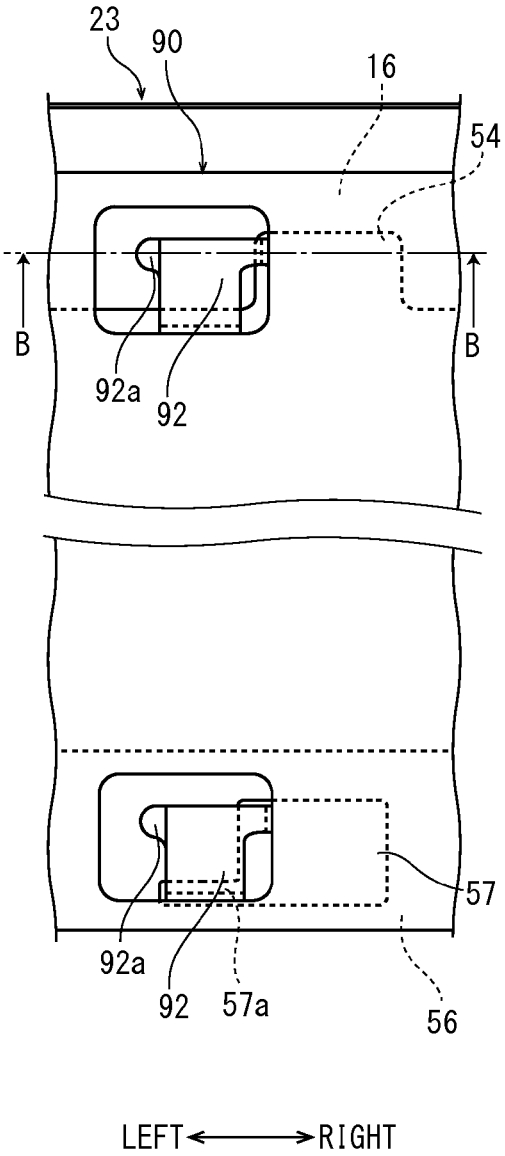
Figure 13B:
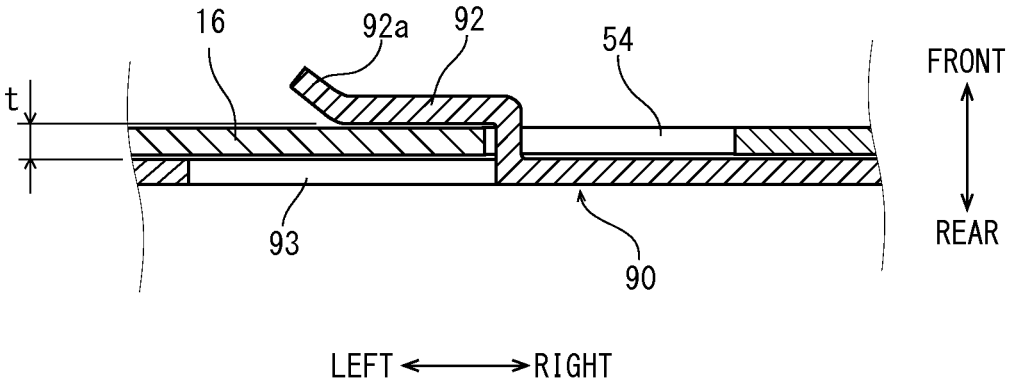
FIG. 13B is a sectional view taken along a line B-B of FIG. 12B.

Subsequently, as shown in FIGS. 12B and 13B, the third cover board 23 is slid in the left direction. Here, in each notch 54, the cut-raised bottom side of each claw piece 92 is slid along the lower edge of each notch 54 and, in each opening 57, the cut-raised bottom side of each claw piece 92 is slid along the extension part 57*a* of each opening 57. Then, from between the protruding parts 92*a* of the claw pieces 92 and the lid body 90, the upper frame and the lower frame 56 are inserted, and then, the upper frame 16 and the lower frame 56 are held between the claw pieces 92 and the lid body 90. Thereby, the claw pieces 92 come into contact with the upper frame 16 and the lower frame 56 and the lid body 90 is electrically conducted to the shield case 50. By setting a slightly narrower gap t (refer to FIGS. 13A and 13B) between each claw piece 92 and the lid body 90 than thicknesses of the upper frame 16 and the lower frame 56, it is possible to heighten holding force of each claw piece 92 due to elastic deformation and to certainly conduct the lid body and the shield case 50. Incidentally, FIG. 11 is illustrated so as to exaggerate a slide width of the third cover board 23, but the third cover board 23 is actually slid by a length in the left and right directions of each claw piece 92.

Figure 14A:
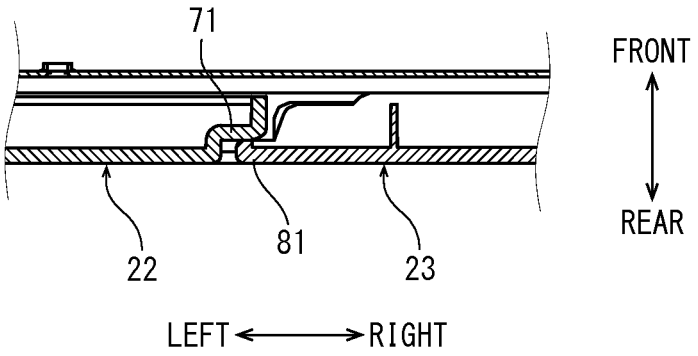
FIGS. 14A and 14B are sectional views showing the third cover in an attaching situation and its peripheral components in the color printer according to the embodiment of the present disclosure.
Figure 14B:
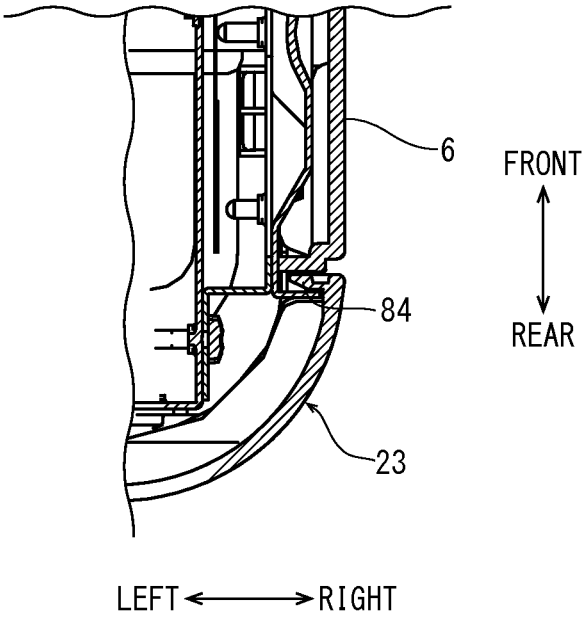

When the third cover board 23 is slid in the left direction, as shown in FIG. 14A, the left edge part 81 of the third cover board 23 is overlapped onto the outside of the overlapping part 71 of the second cover board 22. Further, the engaging pieces 82 formed in the left edge part 81 are respectively engaged with the engaged pieces 72 formed in the right edge of the second cover board 22 and, as shown in FIG. 14B, the claw pieces 84 formed in the right edge part 83 of the third cover board 23 are engaged with the case 6 at a right edge of the third section 13. Moreover, the claw pieces 94 formed in a right edge of the lid body 90 are respectively engaged with the openings 58 formed at a right edge of the shield case 50.

Finally, the screw hole 86 formed at the left bottom corner of the third cover board 23 and the screw hole 59 formed in the center frame 15 in the third section 13 are fastened by a screw, and accordingly, the third cover board 23 is attached to the third section 13. That is, the third cover board 23 is attached to the third section 13 by engaging the claw pieces 92 of the lid body 90 with the upper frame 16 and the lower frame 56 and fastening with the screws. Moreover, contact force of the upper frame 16 and the lower frame 56 with the lid body 90 is strengthened by fastening with the screws and conduction of the shield case 50 and the lid body 90 becomes more certain.

When the first cover board 21, the second cover board 22 and the third cover board 23 are detached, detaching is carried out in reverse order of the above-mentioned attaching order and started from the third cover board 23.

As described above, in the color printer 1 of the present disclosure, since the overlapping part 61 overlapping onto the second cover board 22 is formed in the first cover board 21 and the overlapping part 71 overlapping onto the third cover board 23 is formed in the second cover board 22, the overlapping parts can respectively support the inside cover boards. Therefore, it is possible to decrease attachment positions using the screws. For example, an upper part of the first cover board 21 is provided no screw fastening position and the first cover board 21 and the second cover board 22 are fastened to each other only at one position by one screw. Thus, it is possible to facilitate attaching/detaching work of each cover board 21, 22, 23 and to decrease costs. Incidentally, in a case where the grip part 65 is not provided in the first cover board 21, it is unnecessary to form the screw hole 32*b* in the grip frame 32 and it is possible to attach the first cover board 21 without using the screw.

Moreover, since exposing of the main circuit board 51 adjusted most frequently in setting-up or maintenance can be achieved only by detaching the third cover board 23, it is possible to easily expose the main circuit board 51. At this time, only by removing the screw fastening the screw hole 86 of the third cover board 23 and the screw hole 59 of the center frame 15 and sliding the third cover board 23 in the right direction to extract the claw pieces 92 of the lid body 90 from the notches 54 and the openings 57, it is possible to detach the third cover board 23. That is, since screw fastening is provided only at one position, it is possible to facilitate detaching work and decrease time and labor taken for setting-up work and maintenance work of the main circuit board 51 by a serviceman and others.

Further, since a work attaching the third cover board 23 to the third section 13 brings certain conduction of the shield case 50 and the lid body 90 and shielding with the shield case 50, it is possible to prevent electromagnetic waves generated from the main circuit board 51 from leaking and to prevent noise from entering. Therefore, it is possible to easily attach the lid body 90 to the shield case 50 and to improve shielding performance of the main circuit board 51.

In addition, the image forming part 8 of the image forming unit 2 is arranged inside the first cover board 21, the engine circuit board 41 is arranged inside the second cover board 22, the main circuit board 51 is arranged inside the third cover board 22 and the overlapping parts 61 and 71 are overlapped from the outside in order of the first cover board 21, the second cover board 22 and the third cover board 23. Thereby, since the cover boards can be attached/detached in order from component adjusted more frequently, it is possible to improve efficiency of the setting-up work and the maintenance work.

Incidentally, although, in the embodiment, the third cover board 23 is attached by sliding with respect to the third section 13, the third cover board 23 may be attached by another operation except for the sliding operation. For example, if the third cover board 23 may fitted to the third section 13 and fastened by a screw, screw fastening positions can be decrease as a whole. Alternatively, a boss may be erected in the lid body 90 arranged in an inside face of the third cover board 23 and a hole part into which the boss is fitted when the boss is slid may be formed in the shield case 50. Then, by fitting the boss into the hole part, it is possible to attach the third cover board 23, and simultaneously, to conduct the lid body 90 and the shield case 50.

Incidentally, in a situation where the third cover board 23 is detached, although the second cover board 22 is attached to the second section 12 by fastening the screw at one position, it is possible to maintain an attaching state of the second cover board 22 by engaging the claw pieces 76 with the upper engaged parts 44 or engaging the protruding pieces 75 with the left engaged part 43. Similarly, even if the second cover board 22 and the third cover board 23 are detached, it is possible to maintain an attaching state of the first cover board 21 by engaging the bosses 64 with the through holes 33.

Moreover, although, in the embodiment, the exterior cover 20 covering the rear face of the case 6 is divided into three cover boards 21, 22 and 23, the number of divided boards is not restricted by three.

The embodiment was described in a case of applying the configuration of the present disclosure to the color printer 1. On the other hand, in another embodiment, the configuration of the disclosure may be applied to another image forming apparatus, such as a copying machine, a facsimile or a multifunction peripheral, except for the printer 1.

While the preferable embodiment and its modified example of the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. An image forming apparatus comprising:

an exterior cover having a plurality of faces;

wherein the exterior cover is configured so that one face of the plurality of faces is divided into a plurality of cover boards, the plurality of cover boards are configured so that adjacent cover boards of the plurality of cover boards include respective overlapping parts overlapping onto each other formed in the respective adjacent cover boards and the one face is composed by overlapping the overlapping parts from the outside in predetermined order, the adjacent cover boards is composed of a finally arranged cover board and a previously arranged cover board arranged previous to the finally arranged cover board, and then, when the finally arranged cover board is slid, the overlapping part of the finally arranged cover board is overlapped onto the outside of the overlapping part of the previously arranged cover board.

2. An image forming apparatus comprising:

an exterior cover having a plurality of faces; and a main circuit board controlling image forming operation, wherein the exterior cover is configured so that one face of the plurality of faces is divided into a plurality of cover boards, the plurality of cover boards are configured so that adjacent cover boards of the plurality of cover boards include respective overlapping parts overlapping onto each other formed in the respective adjacent cover boards and the one face is composed by overlapping the overlapping parts from the outside in predetermined order, the main circuit board is arranged inside a finally arranged cover board of the plurality of cover boards.

3. The image forming apparatus according to claim 2 further comprising:

a shield case in which the main circuit board is housed; and an electro-conductive lid body, wherein the shield case is arranged in an inside face of the finally arranged cover board, the shield case and the lid body are conducted by attaching the finally arranged cover board so that the overlapping part of the finally arranged cover board is overlapped onto the outside of the overlapping part of a previously cover board arranged previous to the finally arranged cover board of the plurality of cover boards.

4. The image forming apparatus according to claim 2 further comprising:

a case;

an image forming part housed in the case; and an engine circuit board, wherein the one face is a face outside the case, the plurality of cover boards includes a first cover board constituting a lower half of the one face, a second cover board constituting one part of an upper half of the one face and a third cover board constituting another part of the upper half of the one face, the image forming part is arranged inside the first cover board, the engine circuit board is arranged inside the second cover board, the main circuit board is arranged inside the third cover board, the overlapping parts are overlapped from the outside in order of the first cover board, the second cover board and the third cover board.

* * * * *